US008347937B2

(12) United States Patent
Murphy

(10) Patent No.: US 8,347,937 B2
(45) Date of Patent: Jan. 8, 2013

(54) WINDOW BLIND APPARATUSES, SYSTEMS AND/OR METHODS

(75) Inventor: Mary B. Murphy, Denver, CO (US)

(73) Assignee: No Strings Attached LLC, Denver, CO (US)

( * ) Notice: Subject to any disclaimer, the term of this patent is extended or adjusted under 35 U.S.C. 154(b) by 24 days.

(21) Appl. No.: 12/210,938

(22) Filed: Sep. 15, 2008

(65) Prior Publication Data

US 2010/0065227 A1 Mar. 18, 2010

(51) Int. Cl.
*E06B 3/94* (2006.01)

(52) U.S. Cl. ..... 160/84.04; 160/84.05; 160/84.06; 160/289

(58) Field of Classification Search ..... 160/84.04, 160/84.05, 84.06, 370.23, 383, 172 R, 167 R, 160/289, 290.1, DIG. 16
See application file for complete search history.

(56) References Cited

U.S. PATENT DOCUMENTS 604,329 A * 5/1898 Judge ..... 160/115
1,071,475 A * 8/1913 Sorlie ..... 160/276
2,343,813 A * 3/1944 Lester ..... 160/90
2,948,407 A * 8/1960 Wiszuk ..... 211/105.3
3,253,644 A * 5/1966 Gotoh et al. ..... 160/107
4,024,662 A * 5/1977 Krulwich ..... 40/352
4,586,616 A * 5/1986 Cooper et al. ..... 211/88.04
4,665,964 A * 5/1987 Zommers ..... 160/84.06
4,874,026 A * 10/1989 Worrall ..... 160/23.1
4,880,045 A * 11/1989 Stahler ..... 160/84.04
4,932,704 A * 6/1990 Ament ..... 296/37.16
5,111,866 A * 5/1992 Prostko ..... 160/90
5,275,221 A * 1/1994 Doehlemann ..... 160/84.04
5,492,164 A * 2/1996 Gist ..... 160/102
5,501,342 A * 3/1996 Geibel ..... 206/378
5,522,445 A * 6/1996 Hoffman ..... 160/183
5,868,191 A * 2/1999 Blackmon, Jr. ..... 160/31
5,909,763 A * 6/1999 Link et al. ..... 160/269
6,640,867 B1 * 11/2003 Pallotta et al. ..... 160/84.04
6,860,064 B2 3/2005 Bakalar
6,932,139 B2 * 8/2005 Early et al. ..... 160/107
6,942,001 B1 * 9/2005 Crider et al. ..... 160/241
6,968,885 B2 * 11/2005 Nien ..... 160/172 R
7,114,545 B2 10/2006 Null
7,150,304 B2 12/2006 Hsu
7,185,693 B1 3/2007 Hines
7,237,350 B1 * 7/2007 Zarelius ..... 40/610
7,650,923 B2 * 1/2010 Morris ..... 160/327

(Continued)

OTHER PUBLICATIONS

Alugard, Sonnenschutzsysteme Broschüren, accessed Sep. 15, 2009, http://www.alugard.de, Germany.

(Continued)

*Primary Examiner* — Blair M Johnson
*Assistant Examiner* — Jaime F Cardenas-Garcia
(74) *Attorney, Agent, or Firm* — K Kalan; Gary R. Maze; Berenbaum Weinshienk PC

(57) ABSTRACT

A window blind apparatus having a first magnetically active track, a second magnetically active track, a first rod, a second rod, a first magnet located at the first end of the first rod, and a second magnet located at the second end of the first rod, a third magnet located at the first end of the second rod, a fourth magnet located at the second end of the second rod, and a window covering material adapted to be disposed between the first rod and the second rod, wherein the apparatus is adapted to be used to wholly or partially cover the window over which it is mounted.

20 Claims, 4 Drawing Sheets

U.S. PATENT DOCUMENTS

| | | | | |
|---|---|---|---|---|
| 2002/0069980 | A1* | 6/2002 | Floyd | 160/370.22 |
| 2004/0031575 | A1* | 2/2004 | Nien | 160/172 R |
| 2005/0028944 | A1* | 2/2005 | Early et al. | 160/107 |
| 2005/0230066 | A1* | 10/2005 | Morris | 160/327 |
| 2009/0014134 | A1* | 1/2009 | Hanley et al. | 160/266 |
| 2009/0019804 | A1* | 1/2009 | Spielman | 52/466 |

OTHER PUBLICATIONS

Michael Röling, pictures of Alugard blinds taken in hotel room, about Apr. 30, 2008, Germany.

* cited by examiner

WINDOW BLIND APPARATUSES, SYSTEMS AND/OR METHODS

BACKGROUND

The present developments are directed generally to window blind apparatuses, but more particularly to a magnetic cordless blind apparatus of a type that may typically be used for residential and commercial window coverings.

A window blind apparatus generally consists of instrumentalities to screen a window, with generally similar results to those obtained by fitting curtains. Blind apparatuses may be the same width and height as the window itself or they may be slightly wider, taller, or smaller depending on whether they are fixed inside or outside the window's reveal (i.e. the wall recess within which the window itself is fixed).

Window blind apparatuses may be used for various purposes. They can have the effect of blocking unwanted heat, light of the sun, unwanted viewing from those outside the window or they can have insulative effects in cold weather. They may also reduce or mitigate light to varying degrees, depending on the design. Many kinds of blind apparatuses strive to provide the user with varying balances of privacy and shade. Blind apparatuses may be constructed of a number of different materials and manufactured in a number of different ways. They may be adjustable in a variety of ways to effect the foregoing.

Currently, the market for adjustable window blind apparatuses that can be positioned relative to the window generally includes "top-down, bottom-up" blind apparatuses. Such blind apparatuses generally must be purchased in conjunction with installation services, putting an additional premium on the price. Additionally, of the companies that manufacture cellular blind apparatuses, a few manufacture top-down, bottom-up shades which utilize a cord mechanism to lower and raise the blind apparatuses. This cord mechanism can wear out and/or break.

Other manufacturers market a so-called "cordless lift control," "cordless top-down/bottom-up lift control" or "cordless system" but none of those presently-marketed blinds are truly free of cords. Instead, such blinds generally use a headrail at the top of the window to which cords are attached to raise or lower the blind. Additionally many of the so-called "cordless lift system" features can only be found on top-down blinds.

Improvements and/or alternatives may be available in window blind technologies.

SUMMARY

The present disclosure relates to a window blind apparatus, system, or method by which the window blind may be used. Namely, the developments hereof concern combinations of one or more adjustable magnetically active tracks, a window covering element, a rod or rods, magnets, optionally a handle or handles, and optionally a blind holder piece to keep the lower portion of the blind in place.

The present developments may provide privacy and shade from sunlight, while allowing enhanced functionality due to a cordless feature. A subject blind can be positioned at the top of the window to block sunlight and still allow the user to see outside through the lower portion of the window. It can be positioned at or about the lower half of the window to allow the user to block out the ability of people who are walking by, standing outside or across the street from seeing in while allowing the user to see out through the window over the top of the blind. It can even be positioned in or about the middle of the user's window if the user so chooses.

The present developments may provide adjustability, in that the blinds can be placed in virtually any portion of the window, or fully extended to cover the entire window. To change the blind position the user may move them down from the top of the window or up from the bottom. The movement may be guided by channels in the magnetically active tracks. The window covering element may be mounted on the rod or rods and the rods may be inserted into a tracks and pulled up and down along the track by the user.

DETAILED DESCRIPTION

The developments hereof relate to a blind apparatus, system and/or method, such typically being adapted to enable one or more of easy installation, assembly, and use, and a system and method of use thereof. In many implementations, the blind apparatus has first and second track elements that are adapted to be mounted in parallel alongside a window or similar architectural feature. The track elements may be adapted to receive one or more magnets. The track elements may have a 'c' shape defining a channel running longitudinally along the respective track. Typically, the magnets may be mounted on the end of a rod. The apparatus may include one or more rods, which are disposed to be mounted, with the aid of magnets, such that the respective ends thereof are within the track channels and the rods themselves are thus in a generally perpendicular orientation to the track or tracks. Such a rod may in some instances be a typically dimensioned rod for use in window blind applications. In some implementations, the rod and/or tracks may be extendable and/or retractable. The blind apparatus may typically also include a window covering element of a suitable material such as cloth, paper, or a synthetic, adapted to be coupled with the rod or rods.

Figure 1:
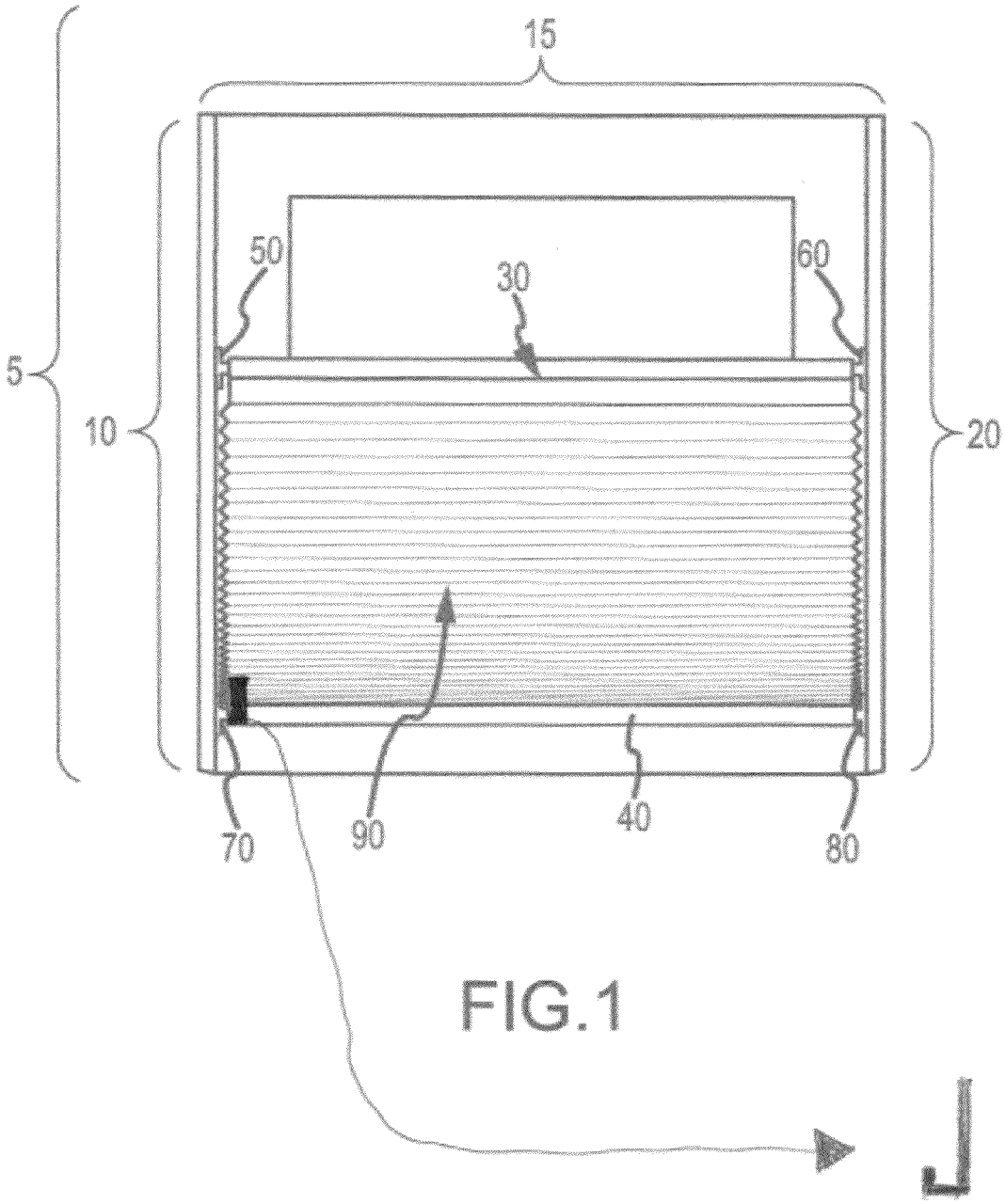
FIG. 1 provides a front elevational view of a blind apparatus hereof.

As generally shown in FIG. 1, an implementation of a blind apparatus 5, as such may typically be used to cover a window 15 in many ordinary residential or commercial environments, may have a first track element 10 and a second track element 20. As shown here, the first track element 10 and second track elements 20 may and be adapted to be mounted on a first vertical portion and the corresponding second vertical portion of the perimeter of the window 15, respectively. The position of the track elements may be on the interior of the window reveal, as generally shown in FIG. 1, or the position may be any suitable position within or outside of the window reveal that would allow for the movement described herein. The first track element 10 and the second track element 20 may be of any suitable length to accommodate the dimensions of the window 15. The first track element 10 and the second track element may be of a fixed length, or they may be pre-scored to allow for selection of a fixed length, or they may be adjustable, for example, telescoping, for ease of adjustment of their respective lengths.

The rod or rods, herein shown as a first rod element 30 and a second rod element 40, may be disposed between the first track element 10 and second track element 20. The first rod element 30 and the second rod element 40 may be adjustable to allow them to be adjusted to be disposed between the first track element 10 and the second track element. The rod elements 30 and 40 may be of any suitable dimension to accommodate the dimensions of the window 15 and the first and second track elements 10 and 20. The first rod element 30 may have a first magnet 50 at the interface between first rod element 30 and first track element 10, and a second magnet 60 at the interface between first rod element 30 and second track element 20. The second rod element 40 may have third magnet 70 at the interface between second rod element 40 and first track element 10, and fourth magnet 80, at the interface between second rod element 40 and second track element 20. The window covering element 90 may be disposed between the first rod element 30 and second rod element 40. The window covering element 90 may be fixedly mounted to each of the first rod element 30 and second rod element 40, in such a manner that the window covering element 90 may movably follow the motion of first rod element 30 and second rod element 40 as they move along the first track element 10 and second track element 20.

Figure 2:
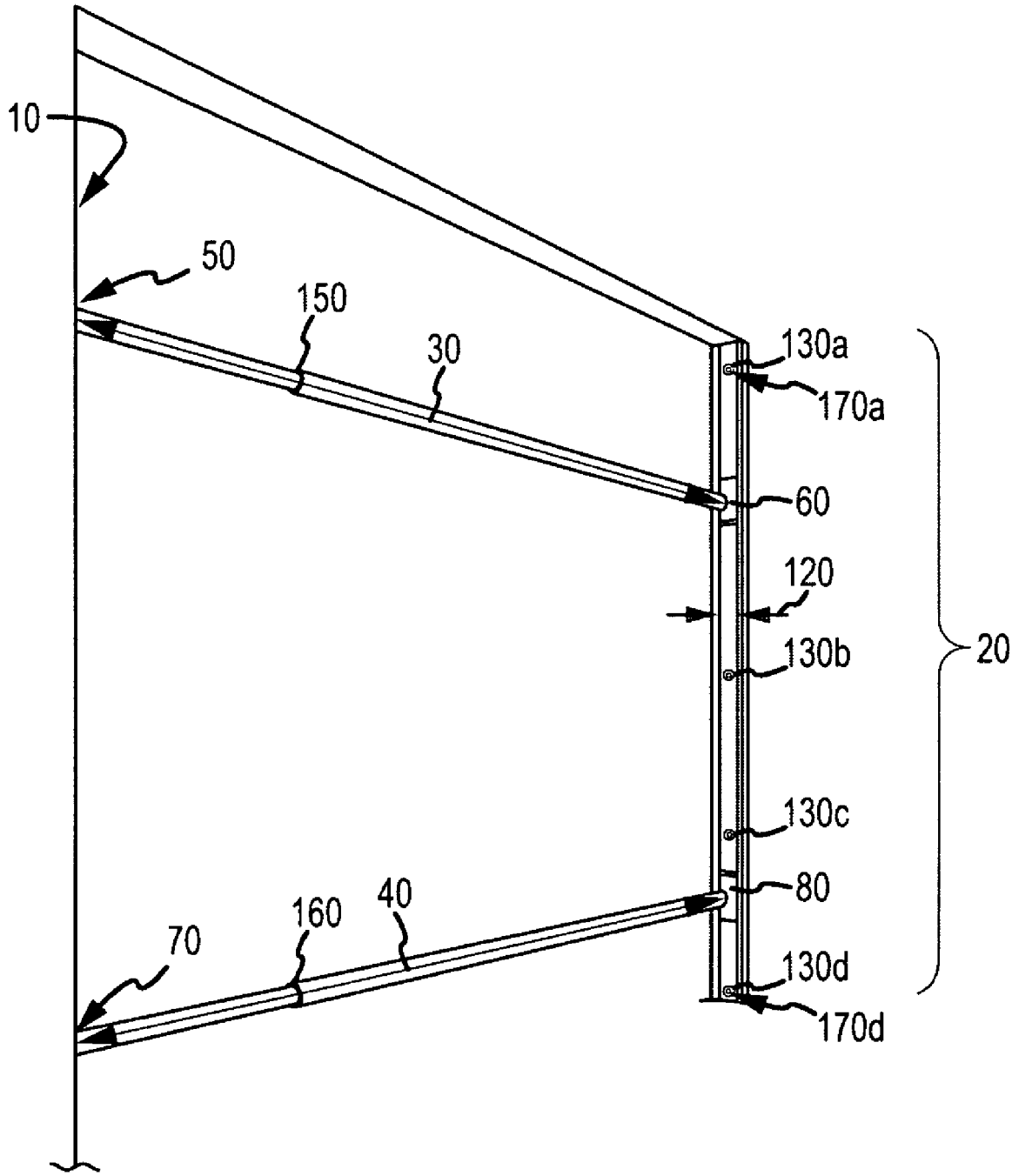
FIG. 2 provides a perspective view of a partially assembled blind apparatus hereof.

FIG. 2 depicts portions of the blind assembly, shown without any window covering element 90. The first rod element 30 and the second rod element 40 are shown in position between the first track element 10 and the second track element 20. The rod element 30 and the rod element 40 may be extendable, as indicated by the telescoping interface 150 on rod element 30 and the telescoping interface 160 on rod element 40. First magnet element 50 of first rod element 30 is depicted in position at the interface between first rod element 30 and first track element 10. Second magnet element 60 of first rod element 30 is depicted in position at the interface between first rod element 30 and second track element 20. Third magnet element 70 of second rod element 40 is depicted in position at the interface between second rod element 40 and first track element 10. Fourth magnet element 80 of second rod element 40 is depicted in position at the interface between second rod element 40 and second track element 20.

Also in FIG. 2, the second track element 20 is depicted as having a channel 120 along the length of the second track element 20. Second magnet element 60 and fourth magnet element 80 are intended to be of a suitable dimension so as to be disposed within channel 120, and channel 120 is intended to be of a suitable width to accept second magnet element 60 and fourth magnet element 80. Although not shown in detail in FIG. 2, first track element 10 may also have a similarly positioned channel of a suitable dimension to receive first magnet element 50 and third magnet element 70. Depicted within channel 120 are apertures 130*a*, 130*b*, 130*c*, and 130*d*. In this figure, aperture 130*a* serves as a mounting point for the second rod element 20, as illustrated by the screw 170*a*. Similarly, aperture 130*d* serves as another mounting point for the second track element 20, as illustrated by the screw 170*d*. Alternatively, the track elements may be mounted to the wall with, for example, any other suitable fixing element, such as a nail, or with an alternative means such as adhesive backing, which may not require a fixing element such as screws or nails. Although the embodiment described herein includes use of magnetically active track elements, magnets at the endpoints of the respective rod elements, and screws for mounting the magnetically active tracks to the wall, alternative embodiments for movement and suspension of the rod elements between the track elements are also contemplated. For example, the track elements may be notched, and the rod elements may be constructed so as to exert pressure against the track elements, allowing for suspension of the rod elements along the track elements at the notched points. Alternatively, another embodiment may employ use of track elements with adhesive properties, constructed to accept rod elements that may or may not be fitted with adhesive endpieces.

Figure 3:
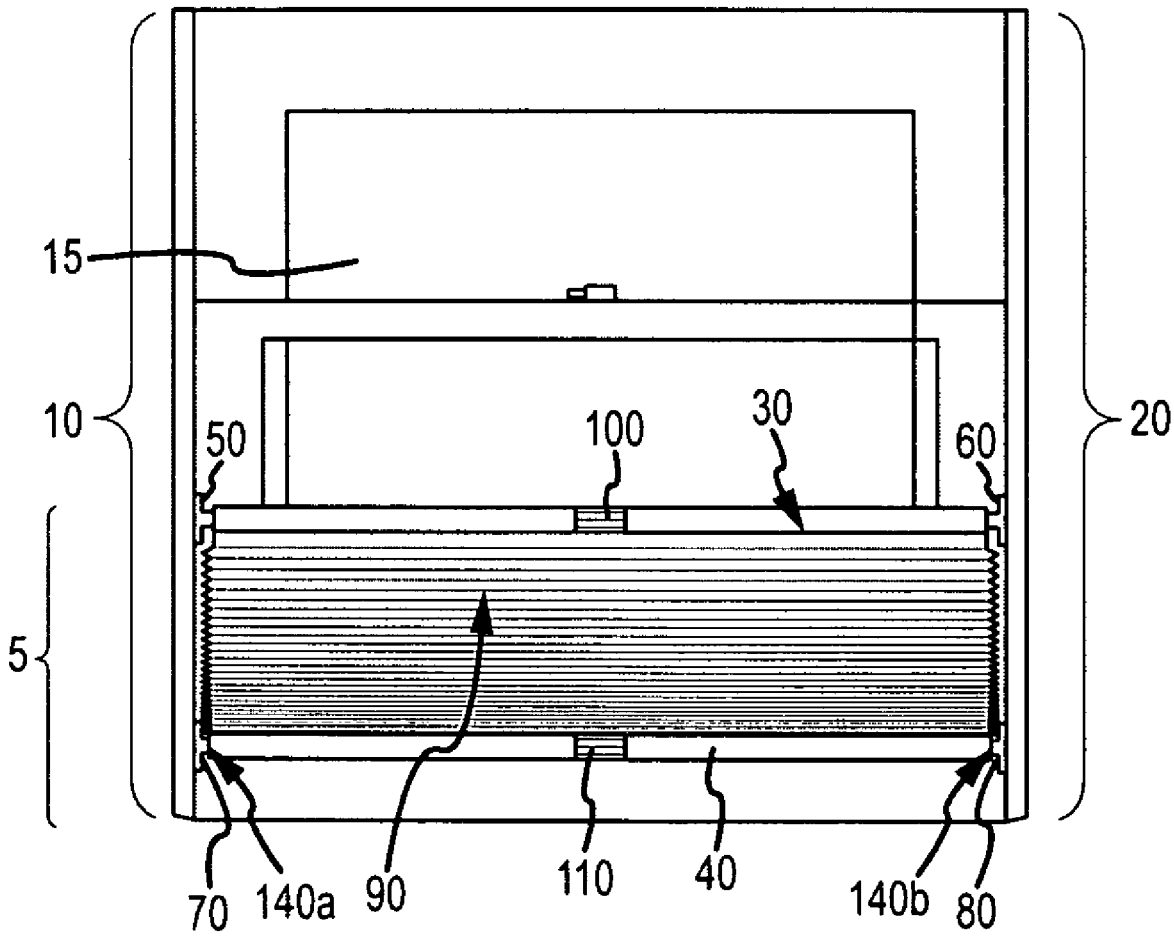
FIG. 3 provides another front elevational view of the blind apparatus as assembled; and, FIG. 4 provides a perspective view of the magnet and track interface.

FIG. 3 illustrates the blind apparatus 5 in use; particularly here being used to partially cover a window 15; this as opposed to the view in FIG. 1 wherein the blind apparatus is in use covering a much larger portion of the window. As illustrated in FIG. 3 and FIG. 1, the blind apparatus 5 may be used in such a manner as to achieve partial extension of the window covering material and thereby partially cover the window. The blind apparatus 5 may also be used in such a manner as to achieve full extension of the window covering material.

The first rod element 30 and the second rod element 40 are shown operationally disposed engaged with each of and between the first track element 10 and the second track element 20. The blind 90 is shown here, suspended from the first rod element 30 and connected to the second rod element 40. Here, the first magnet element 50 and the second magnet element 60 of the first rod element 30 serve to suspend the first rod element at an intervening point along the first track element 10 and second track element 20, i.e., first magnet element 50 of first rod element 30 is at approximately an intervening point of the first track element 10, and second magnet element 60 of first rod element 30 is at approximately a corresponding intervening point of the second track element 20. As in FIG. 1, the second rod element 40 is operationally disposed in this usage at or near the respective lower ends of the two track elements 10 and 20, i.e., third magnet element 70 of second rod element 40 is at or near the lower end of the first track element 10, and fourth magnet element 80 of second rod element 40 is at or near the lower end of the second track element 20. Also shown in FIG. 3 are a first handle 100 disposed at an accessible point along the length of the first rod element 30, and a second handle 110 disposed at a similarly accessible point along the length of the second rod element 40; here each near the midpoints of the respective rod elements 30 and 40. The handles 100 and 110 may be used to adjust the position of the respective rod elements upward or downward along the first and second track elements 10 and 20.

Finally, FIG. 3 depicts blind holders 140*a* and 140*b*, located respectively at the first end and the second end of the second rod 40. The blind holders 140*a* and 140*b* may be clipped into the rod 40 and hold the bottom of the window covering 10 in place.

Figure 4:
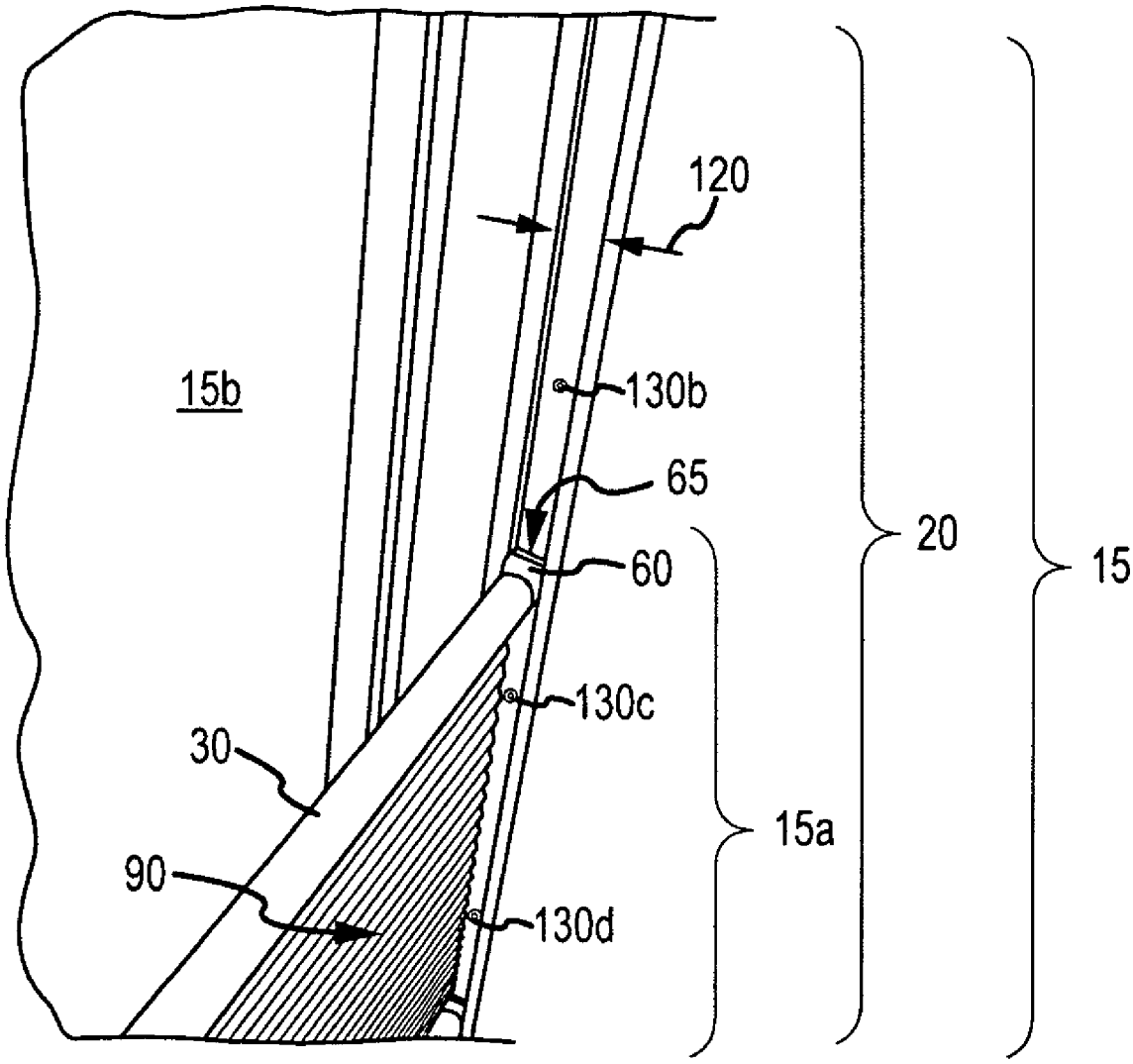

FIG. 4 illustrates an operative position of a magnet within a track element, using as an illustration the second magnet 60 of first rod element 30 as disposed within second track element 20. As shown in FIG. 4, the first rod element 30 is positioned at a point along the second track element 20, with the second magnet element 60 of the first rod element 30 at the interface between first rod element 30 and second track element 20. Second magnet element 60 is shown fitting within the channel 120 defined within the second track element 20. A first side of the magnet, in this case magnet 60, may be attached to the rod 30. A second side of the magnet 60 may interface with the track 20. The magnet 60 may be covered on the second side with a material 65 for the purpose of aiding the rod to glide in the track. The magnet may also be in the form of an endcap or other alternative structure to place over the end of the rod. Window covering element 90 is shown as suspended from first rod element 30 and extends downward from first rod element 30 to cover a first portion 15*a* of the window 15, leaving another, second portion 15*b* of the window 15 uncovered.

Also illustrated are apertures 130*b*, 130*c* and 130*d*, along the length of the second rod element 20. The size and location of the apertures 130*b*, 130*c* and 130*d* (and 130*a*, not depicted in this FIG. 4), may be of any suitable dimension and placement, and may be matched by the corresponding apertures on the first track element 10 (also not depicted in this FIG. 4). Apertures 130*a*, 130*b*, 130*c*, and 130*d* may be pre-formed into and thus be a part of the second track element 20. There may be more or fewer than the four apertures 130*a*, 130*b*, 130*c*, and 130*d* illustrated in FIG. 2, depending on the length of the particular track element. The first track element 10 and the second track element 20 may be of a conventional dimension or they may be pre-scored or adjustable for ease of adjustment of their respective lengths.

An apparatus such as any of the blind apparatuses as described herein may thus provide convenient and easily assemblable ways to cover alternatively all or portions of a window. The ease and/or quickness of assembly and the ready availability of the materials to be used for a blind apparatus hereof can be attractive features for an individual attempting to install their own blinds. Thus, it would not be necessary to contract with or employ professional blind installers, at substantial expense and inconvenience. A standard kit or custom order for a personalized kit containing all the parts needed for the user to assemble the blind apparatus may be provided for the user to construct the apparatus. Then, easy assembly as described above may be achieved, i.e. drilling the screws through the apertures for mounting of the track elements to a wall, or nailing the track to the wall, or using alternative mounting such as adhesive or the like, and assembling the remaining parts of the blind apparatus. Markets for use hereof may include places where blinds are frequently used to cover windows, such as homes, businesses, or similar venues.

As introduced above, a variety of alternative structures may be used in the implementation of the developments hereof. Structures described herein may come in different forms. Thus, for example, the structural element which may provide the connective functionality between the tracks may be other than a rod, and may be specially formed to be adapted to the overall blind apparatus. Window covering elements may be structures other than those specified herein. Moreover, though structures have been shown and described in some detail herein, the scope and content hereof is not so limited, and instead may include alternative structures. Still furthermore, the mechanisms hereof are illustrative only as well and not limitative of the scope and content hereof. Other mechanisms may be used to the same or substantially the same effect, and thus be covered hereby.

Apparatuses hereof may be made by any of a variety of methods and/or of a variety of materials. In many instances, conventional cellular blind fabric may be the most convenient material for the window covering element, but paper or synthetic or other suitable materials may also form the window covering elements. Accordion-style coverings may be one form though other more rigid or flimsy alternatives may be available as well. Metal or other magnetized or magnetizable materials may form the track elements and the rod elements to create the magnetically active track(s). Shapes and sizes are not limited to those shown and described here either, as sizes and shapes may be selected to adapt to any of many alternative structures.

Historically, window coverings were a means to end, in that they would either block the outside world or let the outside world in, with little degree of control as to how much or how little they blocked. The present developments imparts a sense of freedom by allowing the user to choose a privacy level while simultaneously affording the user an opportunity to remain connected to the outside world. For example, if the user wants to sit inside a residence and read but not have to view passersby or nearby buildings, the present development may be adjusted to a suitable position so as to block those views yet still allow the user a view of the sky. Similarly, if the user wants some protection from the glare of the sun, but not complete window coverage, the blind may be adjusted to a different suitable position.

The present development may operate with a minimum of components. Installation is intended to be easy and to require minimal tools and time. The average consumer may be able to complete installation of one window blind in 30 minutes or less.

For example, the pre-installation of the present development may involve the steps of measuring one's windows, ordering the blinds on-line, and installing the blinds, with readily available tools such as a drill and a pair of scissors. The product may be offered in standard sizes corresponding to the most common window dimensions. Additionally, further customization of the product may be achieved, as the magnetically active tracks may be scored at regular intervals to allow a better fit in the window frame or may be adjustable so as to be extended or contracted to the desired size. The blinds may be made of a fabric that can easily be trimmed with a scissors if necessary. The packaging may include a fabric guide for a straight cut. Additional time savings may be realized in not having to adhere to an installer's schedule as the consumer can install the product when it is convenient for them.

Apparatuses hereof may be made by any of a variety of methods and/or of a variety of materials. In many instances, conventional cellular blind fabric may be the most convenient material for the window covering element, but paper or synthetic or other suitable materials may also form the window covering elements. Accordion-style coverings may be one form though other more rigid or flimsy alternatives may be available as well. Metal or other magnetized or magnetizable materials may form the track elements to create the magnetically active track(s). Metal or other magnetized or magnetizable materials may form the rod elements. Shapes and sizes are not limited to those shown and described here either, as sizes and shapes may be selected to adapt to any of many alternative structures.

Thus provided is a window blind which may be one or more of cordless, easily positionable, durable, and easily installed window blind that may be placed in variety of positions to adapt to the user's particular needs for, e.g., privacy and sunlight blockage while remaining connected to the outside world.

Although the present developments have been described with reference to certain implementations, workers skilled in the art will recognize that changes may be made in form and detail without departing from the spirit and scope of the development described herein.

What is claimed is:

1. A cordless window blind apparatus, comprising:

a. a first magnetically active track defining a single, substantially "C" shaped channel running longitudinally along an axis of the first magnetically active track;

b. a second magnetically active track defining a single, substantially "C" shaped channel running longitudinally along an axis of the second magnetically active track, the respective first and second magnetically active substantially "C" shaped channels meant to be installed facing each other;

c. a first rod comprising a first end and a second end distally located from the first end of the first rod, the first end of the first rod comprising a first magnet dimensioned and adapted to magnetically and slidingly engage the first magnetically active track, and the second end of the first rod comprising a second magnet dimensioned and adapted to magnetically and slidingly engage the second magnetically active track;

d. a second rod comprising a first end and a second end distally located from the first end of the second rod, the first end of the second rod comprising a third magnet dimensioned and adapted to magnetically and slidingly engage the first magnetically active track, the second end of the second rod comprising a fourth magnet dimensioned and adapted to magnetically and slidingly engage the second magnetically active track; and e. a window covering material cordlessly connected to the first rod and the second rod, the window covering material comprising a first end and a second end, the first end and the second end cordlessly connected to the first rod and the second rod, respectively, the window covering material unattached directly or indirectly to the first and second tracks other than by the first and second rods at the first and second ends.

2. The window blind apparatus of claim 1, wherein the first magnetically active track and the second magnetically active track are adapted to be mounted on a surface in an orientation generally perpendicular to the ground.

3. The window blind apparatus of claim 1, wherein the first magnetically active track and the second magnetically active track are adapted to be mounted on opposite vertical sides of a window.

4. The window blind apparatus of claim 1, wherein the first magnetically active track and the second magnetically active track are adapted to be mounted on opposite vertical sides of the interior of a window reveal.

5. The window blind apparatus of claim 1, further comprising a handle mounted on the first rod, the handle adapted to be held by an operator's hand.

6. The window blind apparatus of claim 1, further comprising an L-shaped blind holder attached to the first rod, a shorter arm of the L-shaped blind holder dimensioned and adapted to clip into the first rod and a longer arm of the L-shaped blind holder dimensioned and adapted to hold a lower part of the window covering material in place.

7. The window blind apparatus of claim 1, wherein the open portions of the respective "C" shaped channels face each other across opposite vertical sides of the interior of a window reveal.

8. The window blind apparatus of claim 7, wherein the channel of the first magnetically active track is adapted to receive the first magnet element and the third magnet element, and the channel of the second magnetically active track is adapted to receive the second magnet element and the fourth magnet element.

9. The window blind apparatus of claim 1, further comprising a first mounting aperturedisposed at a predetermined position along the first magnetically active track and a second mounting aperture disposed at a predetermined position along the second magnetically active track, each mounting aperture dimensioned and configured to accept a mounting screw dimensioned and configured for mounting a respective magnetically active track to a wall.

10. The window blind apparatus of claim 1, wherein each of the first magnetically active track and the second magnetically active track further comprises an adhesive backing material adapted to adhesively mount a respective magnetically active track to a wall.

11. The window blind apparatus of claim 1, wherein the first rod is adjustable in length.

12. The window blind apparatus of claim 1, wherein the first track is scored at regular intervals so as to be adjustable in length.

13. A window blind apparatus as recited in claim 1, wherein the first magnetically active track and the second magnetically active track may be positioned at any distance in relation to each other limited only by the length of the first rod and second rod and the dimensions of the window structure.

14. A window blind apparatus as recited in claim 1, wherein the first rod is inserted through a first end of the window covering material and the second rod is inserted through a second end of the window covering material.

15. A window blind apparatus as recited in claim 1, wherein a soft friction-reducing covering is placed over the first magnet, second magnet, third magnet and fourth magnet.

16. A window blind apparatus as recited in claim 1, wherein the first and second rods are adapted to be removably disposed such that respective first and second ends are operatively magnetically engaged within the first and second tracks such that the first and third magnets are adapted to fixedly yet movably magnetically engage with the first and second tracks and the second and fourth magnets are adapted to fixedly yet movably magnetically engage within the first and second tracks.

17. A window blind system, comprising:

a. a first magnetically active track defining a single, substantially 'C' shaped channel running longitudinally along an axis of the first magnetically active track;

b. a second magnetically active track defining a single, substantially 'C' shaped channel running longitudinally along an axis of the second magnetically active track, the respective substantially single 'C' shaped channels of the first and second magnetically active tracks arranged parallel to and facing each other;

c. an adjustable first rod, comprising a first end and a second end distally located from the first end of the first rod, the first end of the first rod comprising a first magnet dimensioned and adapted to magnetically and slidingly engage the first magnetically active track, and the second end of the first rod comprising a second magnet dimensioned and adapted to magnetically and slidingly engage the second magnetically active track;

d. a second rod comprising a first end and a second end distally located from the first end of the second rod, the first end of the second rod comprising a third magnet dimensioned and adapted to magnetically and slidingly engage the first magnetically active track, the second end of the second rod comprising a fourth magnet dimensioned and adapted to magnetically and slidingly engage the second magnetically active track; and e. a window covering material comprising a first end and a second end, the first end and the second end cordlessly connected to the first rod and the second rod, respectively, the window covering material unattached directly or indirectly to the first and second tracks other than by the first and second rods at the first and second ends.

18. A method for providing readily-alterable coverings for a window, the method comprising:

a. mounting a first track to a first portion of a wall, the first track defining a substantially 'C' shaped channel running longitudinally along an axis of the first track;

b. mounting a second track to a second portion of the wall in a substantially parallel orientation to the first track element, the second track defining a substantially 'C' shaped channel running longitudinally along an axis of the second track, the respective single 'C' shaped channels facing each other;

c. attaching a first end of a window covering material to a first rod and a second end of the window covering material to a second rod, the window covering material unattached directly or indirectly to the first and second tracks other than by the first and second rods at the first and second ends, the window covering material cordlessly disposed within the first and second tracks;

d. placing the first rod between the substantially 'C' shaped channel of the first track and the substantially 'C' shaped channel of the second track, the first rod comprising a first end comprising a first magnet adapted to be removably disposed within the substantially 'C' shaped channel of the first track and further comprising a second end comprising a second magnet adapted to be removably disposed within the substantially 'C' shaped channel of the second track; and e. placing the second rod between the first track and the second track, in a substantially parallel orientation to the first rod, the second rod comprising a first end comprising a third magnet adapted to be removably disposed within the substantially 'C' shaped channel of the first track and further comprising a second end comprising a fourth magnet adapted to be removably disposed within the substantially 'C' shaped channel of the second track.

19. The method of claim 18, further comprising positioning the first rod and the second rod at discrete points along the first track and the second track in such a manner as to achieve at least one of full extension of the window covering material and partial extension of the window covering material.

20. The window blind apparatus of claim 9, wherein the first and second mounting apertures comprise a plurality of mounting apertures placed at intervals starting at three inches from a top of their respective magnetically active track and at 10-inch intervals thereafter.

* * * * *